US006300911B1

(12) United States Patent
Murray et al.

(10) Patent No.: US 6,300,911 B1
(45) Date of Patent: Oct. 9, 2001

(54) ANTENNA ASSEMBLY

(75) Inventors: Thomas A. Murray, Plantation; Donald W. Burnette, Sunrise, both of FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/579,693

(22) Filed: May 26, 2000

(51) Int. Cl.[7] ..... H01Q 1/24
(52) U.S. Cl. ..... 343/702; 343/900
(58) Field of Search ..... 343/702, 900, 343/901, 903

(56) References Cited

U.S. PATENT DOCUMENTS 5,151,047 * 9/1992 Phillips ..... 439/333
5,343,213 8/1994 Kottke et al. ..... 343/702
5,576,720 * 11/1996 Gorenz, Jr. et al. ..... 343/702
5,710,567 1/1998 Funke ..... 343/702
5,949,386 * 9/1999 Elliott ..... 343/906
6,157,350 * 12/2000 House et al. ..... 343/906

* cited by examiner

*Primary Examiner*—Don Wong
*Assistant Examiner*—Hoang Nguyen
(74) *Attorney, Agent, or Firm*—Scott M. Garrett; Barbara R. Doutre

(57) ABSTRACT

An antenna assembly (100) includes an antenna (114), antenna mounting base (108), and a radio housing (102). The antenna mounting base (108) includes a through-hole (112) and a snap beam (116). The antenna (114) is inserted into the mounting base (108) via the through-hole (112), and the mounting base snap fits into the radio housing (102) via the snap beam (116). The snap beam (116) operates as both a snap-fit feature for retaining the antenna mounting base within the housing ((102) and as a release mechanism for removing the antenna mounting base from the housing.

10 Claims, 4 Drawing Sheets

108

114

ANTENNA ASSEMBLY

TECHNICAL FIELD

This invention relates in general to portable communication devices and more particularly to the antennas associated with those devices.

BACKGROUND

Portable communication devices, such as cellular phones and two-way radios, are increasing in popularity. The user interface and ergonomics implemented in handheld devices often dictates whether a consumer will purchase one product over another. Yet user ergonomics must also be weighed against ease of assembly and disassembly from a manufacturing and servicing standpoint. Handsets that are easily assembled are less expensive to produce thus allowing the cost of the handset to remain competitive. For handsets that are capable of being serviced, simple disassembly keeps service costs down and minimizes damage to the device.

There are a variety of assembly mechanisms in the antenna arena associated with handheld devices. An antenna that can be screwed into its housing often requires a tool, such as a torque driver, to insure correct installation without overstressing or stripping the device. Snap-in antennas provide the convenience of eliminating the need for an external tool, but often necessitate disassembling the entire handset housing in order to access the antenna. Problems with misalignment and breakage have been associated with many prior art antennas in all facets of use including assembly, disassembly, and user interface.

Accordingly, it would be beneficial to have a simplified antenna assembly that would give an appropriate balance between ergonomic features and robustness along with ease of assembly and disassembly.

DETAILED DESCRIPTION OF THE PREFERRED EMBODIMENT

Figure 1:
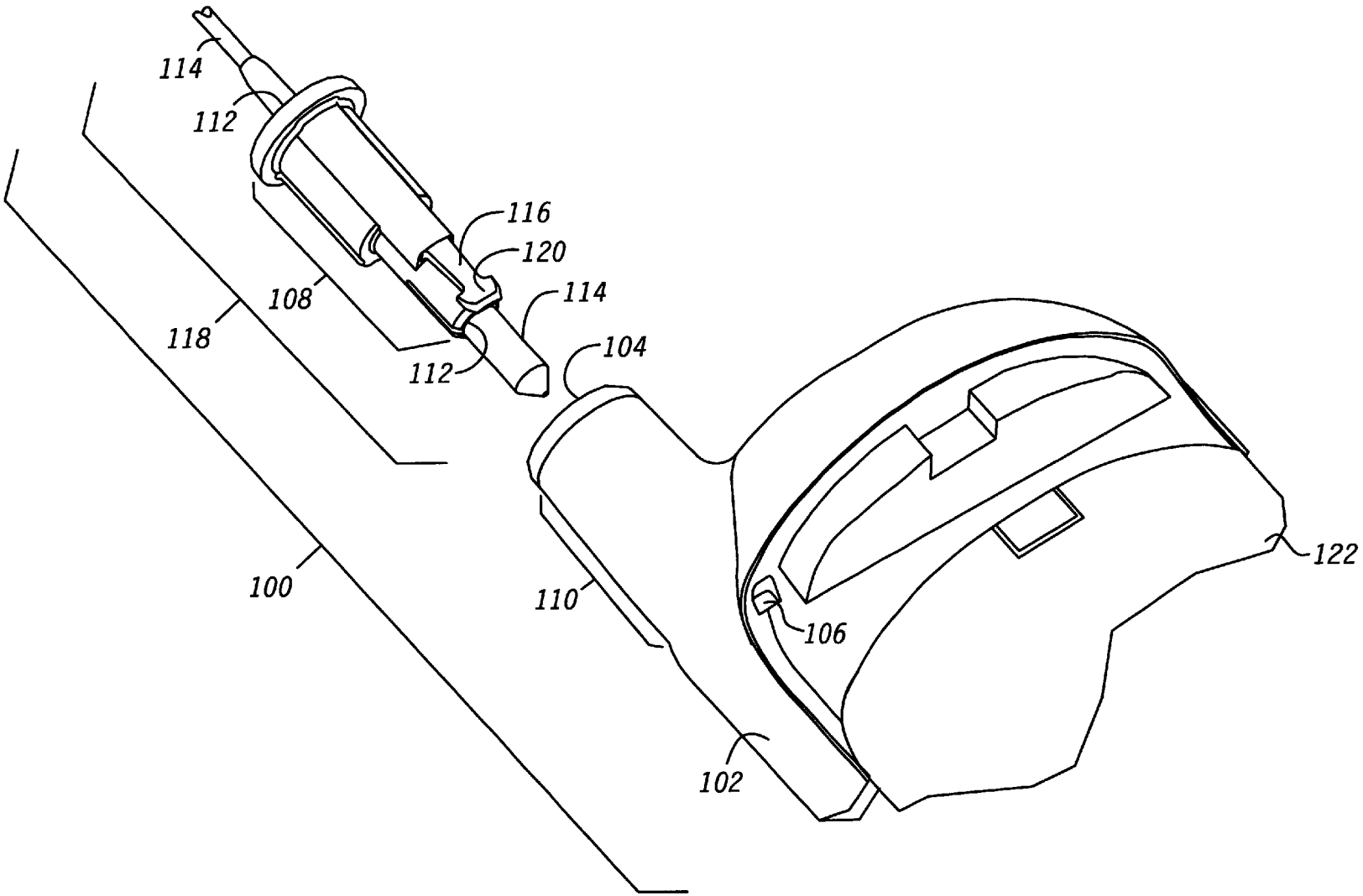
FIG. 1 is an exploded view of radio housing and an antenna mounting base with an antenna inserted therein in accordance with the present invention.

Referring to FIG. 1, there is shown an exploded view of radio housing and an antenna mounting base with antenna inserted therein in accordance with the present invention. In accordance with the present invention, an antenna assembly 100 includes a radio housing 102 having first and second apertures 104, 106 respectively. The first aperture 104 is an opening for receiving and antenna mounting base 108. The radio housing 102 is preferably formed so as to include an antenna receptacle portion 110, which is a tube-like portion extending from the housing. However, the radio antenna receptacle portion 110 and its contents could also be enclosed within the radio so as to have a flush top mounting as well. The second aperture 106 is preferably located behind a battery back cover 122, but could alternatively be on the housing itself. The second aperture 106 serves as a disengaging mechanism that allows the antenna mounting base to be removed from the radio in a manner to be described herein.

Figure 2:
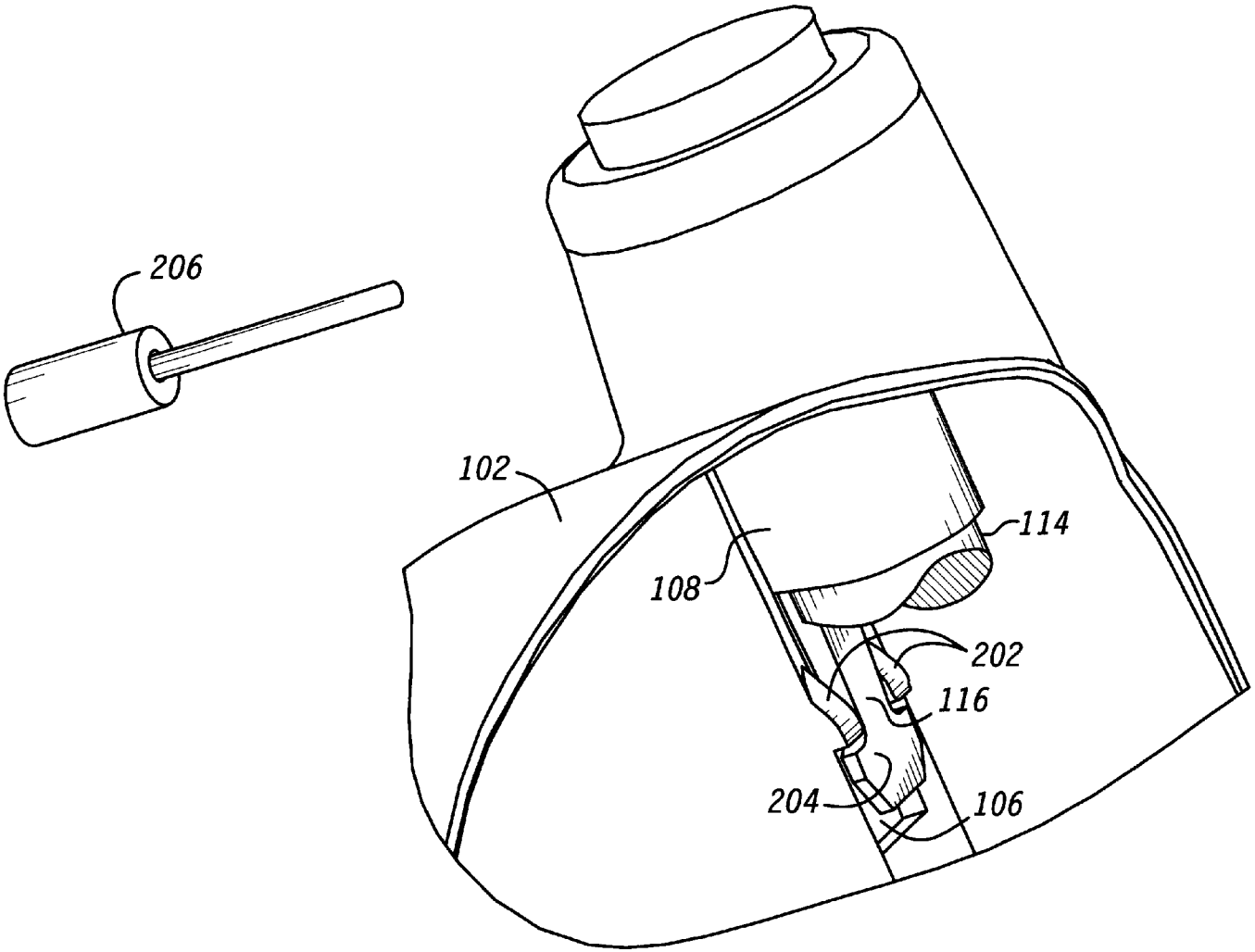
FIG. 2 is a cut away view of the front of the radio housing with a cut away view of the antenna mounting base and antenna inserted therein in accordance with the present invention.

The antenna mounting base 108 is formed of a single piece of material, such as a single piece of injection molded plastic, and includes a through-hole 112 through which retractable antenna 114 is inserted. The antenna mounting base 108 and antenna 114 inserted therein form a single element 118 for assembly into radio housing 102. The antenna mounting base 108 is insertable into the first aperture 104 of housing 102, and in accordance with the present invention includes a snap beam 116 molded thereon. The snap beam 116 is basically an extension of the molded plastic and includes a hook or flared end 120. Once inserted into the radio housing 102, the snap beam 116 of the present invention becomes engaged and retained by at least one ramp protrusion 202 shown in FIG. 2. FIG. 2 is a cut away view of the front of housing 102 with a cut away view of the antenna mounting base 108 and antenna 114 inserted therein. The mounting base 108 is cut back so as to show the snap fit interconnect between the snap beam 116 and the ramp protrusions 202. The housing 102 includes at least one ramp protrusion 202 for engaging the snap beam 116 in order to engage and retain the antenna mounting base 108 along with antenna 114 within the radio housing. Once the antenna mounting base 108 is fully inserted into the radio housing 102, the second aperture 106 aligns with the snap beam 116 as shown in FIG. 2. The second aperture 106 can then be accessed with an external source 206, such as a paperclip, pen or pick, to allow disengagement of the snap beam 116 for removal of the antenna mounting base 108 along with antenna 114 from the housing 102. Thus, in accordance with the present invention, the snap beam 116 operates to snap fit the mounting base into the housing 102 and also operates as a release mechanism for removing the antenna mounting base from the housing.

Placing the second aperture 106 behind the battery cover 122 helps minimize water intrusion and accidental removal of the antenna by the user while making it extremely easy for a service technician to remove the assembly in order to perform diagnostic testing on the radio. Alternately, the entire antenna mounting base 108 and housing ramp protrusions 202 could be reoriented to allow external access from a variety of angles, such as the front or side of the radio housing 102.

Figure 3:
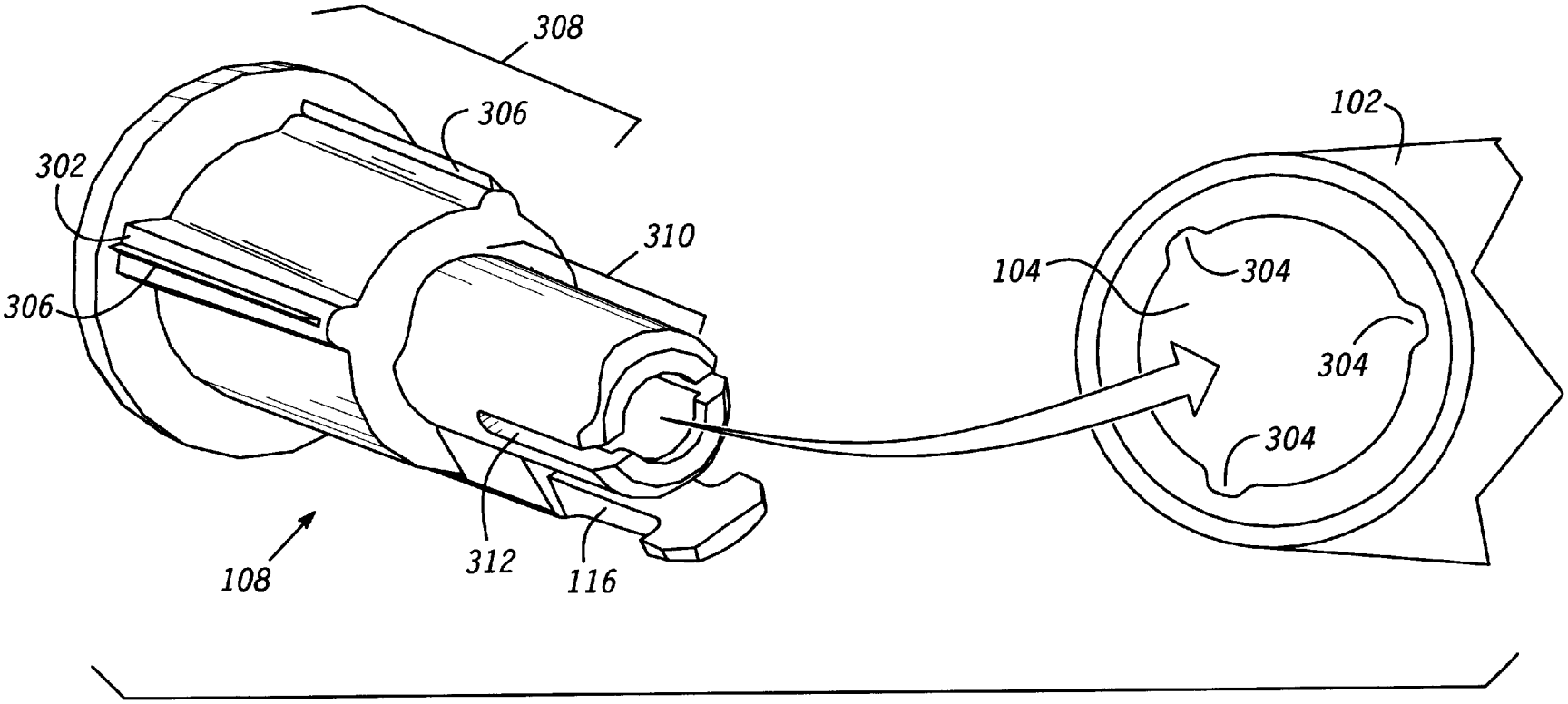
FIG. 3 is an isometric view of the antenna mounting base in accordance with a preferred embodiment of the invention.

FIG. 3 shows another view of the antenna mounting base 108. In accordance with the present invention, the antenna mounting base includes the snap beam 116 as previously described. The antenna mounting base 108 also preferably includes guide rails 302 which align with alignment slots 304 preferably located along the edge of the first aperture 104 of housing 102. The guide rails 302 and alignment slots 304 provide for radial alignment of the antenna mounting base 108 within housing 102. The guide rails 302 may also include a crush rib 306 which deforms upon insertion of the guide rail into the alignment slot 304 to improve alignment of the snap beam 116 with the ramp protrusion 202. The tube-like mounting base 108 has a wider diameter top section 308 to accommodate a helical antenna coil if desired, while the bottom section 310 preferably has a narrower diameter and preferably includes side slits 312 to provide deflection for the insertion of the antenna bottom to be described herein.

Figure 4D:
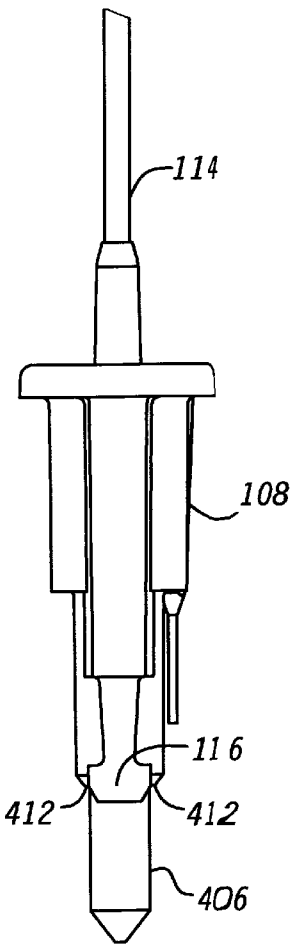
FIG. 4D is a full view of the antenna inserted within the mounting base in accordance with the present invention.
Figure 4C:
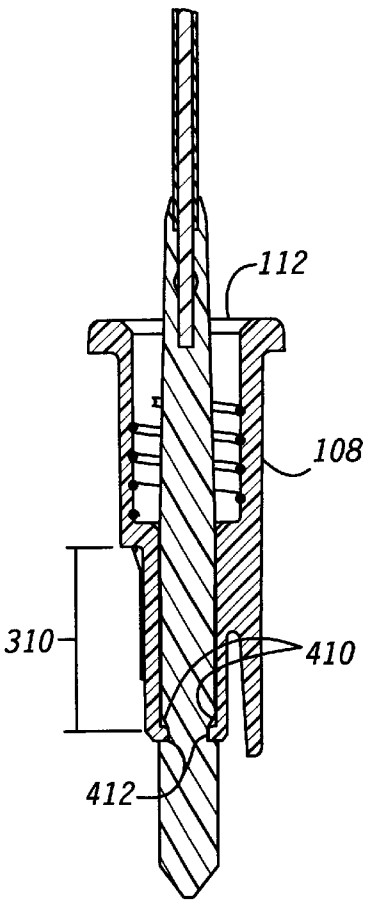
FIG. 4C is a sectional view of the antenna inserted within the mounting base in accordance with the present invention.
Figure 4B:
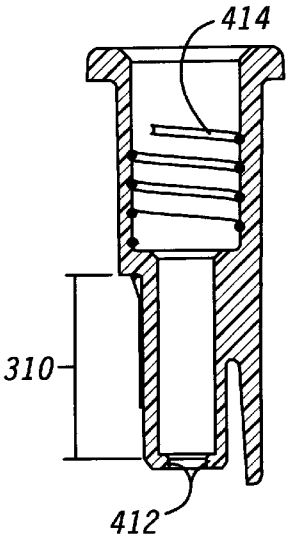
FIG. 4B is a sectional view of the antenna mounting base in accordance with the present invention.
Figure 4A:
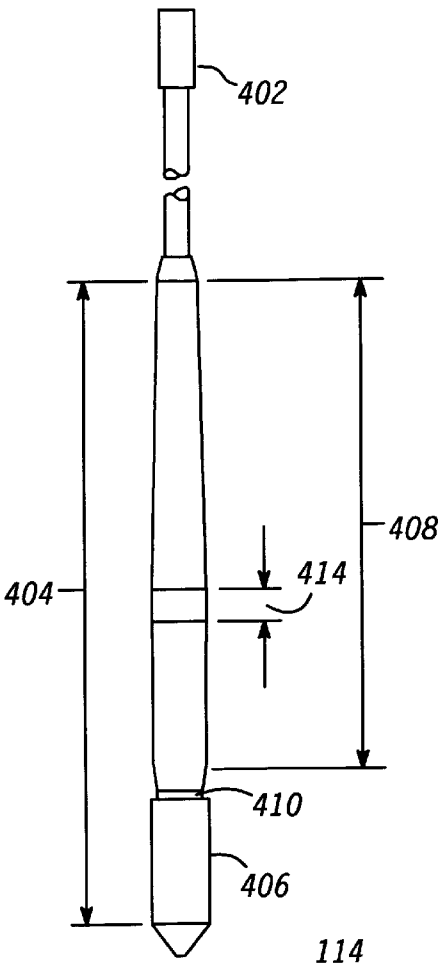
FIG. 4A is an antenna in accordance with the preferred embodiment of the invention.

To discuss further preferred embodiments of the antenna 114 and antenna mounting base 108, there are shown a variety of views in FIGS. 4A, B, C and D. FIG. 4A is a view of the antenna 114 in accordance with a preferred embodiment of the invention, and FIG. 4B is a sectional view of the antenna mounting base in accordance with the preferred embodiment. FIG. 4C is a cross sectional view of the antenna 114 inserted within the antenna mounting base 108, and FIG. 4D is a full view of the antenna inserted into the mounting base in accordance with the preferred embodiment. Antenna 114 may be a whip antenna, such as a radiating half wavelength whip antenna. The antenna mounting base 108 may include a helical antenna 414, such as a quarter wave helical, in the wider top section 308, as shown in FIGS. 4B and 4C. The helical antenna 414 electromagnetically couples to a conductor 416 of the whip antenna 114.

In accordance a preferred embodiment of the invention, antenna 114 includes a top holding section 402 which prevents complete insertion of the antenna into the radio housing. Antenna 114 also includes a bottom holding section 404 which consists of two parts, a stopper portion 406 and, in accordance with the preferred embodiment, a vibration minimizer portion 408. The stopper portion 406 is located at the base of the antenna and has a slightly larger diameter than the mounting base's bottom section 310, and the stopper includes a notched out top 410. In accordance with the preferred embodiment, the antenna mounting base 108 includes squared off detentes 412, shown in FIG. 4B, to provide a restrictive constraint for the notch 410. As the antenna 114 is inserted into the upper through-hole 112 of mounting base 108, the stopper portion 406 goes beyond the bottom section 310 and through the bottom of through-hole 112 where the detentes 412 bite into and capture the notch 410 thereby preventing removal of the antenna from the mounting base 108 as shown in FIG. 4C.

Also, in accordance with the preferred embodiment, the antenna's vibration minimizer portion 408 shown in FIG. 4A is formed of a graduated diametral profile 414. In accordance with the preferred embodiment, the diametral profile 414 slows down movement of the antenna through the through-hole 112 and provides a snug fit when the antenna is fully extended as shown in FIG. 4C so as to minimize antenna vibration.

FIG. 4D shows the full view of the antenna 114 inserted into the antenna mounting base 108 in a fully extended position in accordance with the preferred embodiment. Detentes 412 have captured the stopper section 406 preventing further upward movement of the antenna 114. Though the preferred embodiment describes a retractable antenna, a stationary or "stubby" antenna could also benefit from the antenna assembly of the present invention. In the stationary case, the antenna and mounting base are unitarily molded as a single piece part but still use the snap beam 116 and housing ramp protrusions 202 in order to benefit of the disengagement mechanism of the present invention.

Thus, the antenna assembly 100 of the present invention provides an antenna 114 that snaps into a mounting base 108 and a mounting base that snaps into a radio housing 102. Disassembly is performed by accessing the second aperture 106 to release the snap beam 116 and remove the mounting base 108 with antenna 114 as a single unit out of the radio. The antenna assembly of the present invention provides ease of assembly and disassembly while satisfying user interface ergonomics. The snap-in characteristics make the assembly reliable and minimize the need for mechanical adjustment and so it is well suited for the manufacturing environment. Service facilities can now remove and replace the antenna or perform radio frequency (RF) diagnostic tests without opening the entire housing thus saving time, money, and minimizing breakage. And, last but not least, the end user is less likely to be able to pull out the antenna and is provided with the benefit of minimized antenna vibration.

Numerous modifications, changes, variations, substitutions and equivalents will occur to those skilled in the art without departing from the spirit and scope of the present invention as defined by the appended claims.

What is claimed is:

1. An antenna assembly, comprising:

an antenna;

a mounting base having a through-hole and a snap beam, the antenna being insertable into the mounting base via the through-hole;

a radio housing having first and second apertures, the first aperture for receiving the mounting base, the mounting base snap fitting into the radio housing via the snap beam, and wherein the snap beam is accessible via the second aperture for releasing the antenna mounting base and antenna from the radio housing.

2. An antenna assembly, comprising:

a radio housing having first and second apertures formed therein and also having at least one ramp protrusion formed therein;

an antenna mounting base, the antenna mounting base being insertable into the first aperture, the antenna mounting base including a snap beam, the snap beam being engaged and retained by the by the at least one ramp protrusion, the second aperture aligning with the snap beam to allow disengagement of the snap beam from an external source; and an antenna coupled to the mounting base.

3. An antenna assembly as described in claim 2, wherein the antenna is unitarily molded with the antenna mounting base.

4. An antenna assembly as described in claim 2, wherein the antenna is a retractable antenna.

5. An antenna assembly as described in claim 2, wherein the antenna has a graduated diametral profile.

6. An antenna assembly as described in claim 2, wherein the antenna includes a notch, and wherein the antenna mounting base includes a detente mechanism formed of a squared off profile for retaining the notch of the antenna.

7. An antenna assembly as described in claim 2, wherein the radio housing includes a battery cover, and the second aperture is located on the radio housing behind the battery cover.

8. An antenna assembly as described in claim 7, wherein the guide rails each include a crush rib that deforms upon insertion of the guide rails into the alignment slots.

9. An antenna assembly as described in claim 2, wherein the antenna mounting base includes guide rails, and wherein the first aperture of the radio housing includes alignment slots for receiving the guide rails.

10. A snap-in antenna assembly, comprising:

a radio housing having a top opening and at least one side opening and having at least one ramp protrusion within the housing aligned with the side opening;

an antenna mounting base, the antenna mounting base being insertable into the top opening of the radio housing, the antenna mounting base including at least one snap beam protruding therefrom, the at least one snap beam being engaged and retained by the at least one ramp protrusion when the antenna mounting base is inserted into the radio housing; and an antenna operatively coupled to the mounting base; and the at least one side opening providing access the at least one snap beam so as to disengage the at least one snap beam from the at least one ramp protrusion to allow removal of the antenna mounting base and antenna from the radio housing.

* * * * *